US007442066B1

(12) United States Patent
Ho et al.

(10) Patent No.: US 7,442,066 B1
(45) Date of Patent: Oct. 28, 2008

(54) PLUG CONNECTOR

(75) Inventors: Hsin-Tsung Ho, Taipei Hsien (TW); Shu-Man Chiang, Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/016,972

(22) Filed: Jan. 18, 2008

(51) Int. Cl.
*H01R 13/627* (2006.01)

(52) U.S. Cl. ..... 439/358; 439/352

(58) Field of Classification Search ..... 439/352, 439/357, 358
See application file for complete search history.

(56) References Cited

U.S. PATENT DOCUMENTS 6,413,112 B2 * 7/2002 Semmeling et al. ..... 439/358

7,318,741 B2 * 1/2008 Wu ..... 439/354

* cited by examiner

*Primary Examiner*—Truc T Nguyen
(74) *Attorney, Agent, or Firm*—WPAT, P.C.; Anthony King

(57) ABSTRACT

A plug connector includes an insulating housing, a plurality of terminals and two latches. The insulating housing has a base and a tongue portion protruding forward from the front of the base. The terminals are received in the insulating housing. Two cavities are defined at two sides of the base and the tongue portion for receiving the respective latches. Each of the latches has a fixing portion. The fixing portion extends forward and inclines downward to form a first elastic arm. A free end of the first elastic arm extends forward and inclines upward to form a second elastic arm. The second elastic arm protrudes upward to form a hook at a free end thereof and a support portion lower than the hook at the rear of the hook. The hook and the support portion stretch out of the cavity to rise above the tongue portion.

6 Claims, 6 Drawing Sheets

PLUG CONNECTOR

BACKGROUND OF THE INVENTION

1. Field of the Invention

The present invention relates to a plug connector, and more particularly to a plug connector with latches.

2. The Related Art

Referring to FIG. 1, a traditional latch 70 has an U-shaped fixing portion, the fixing portion has an upper arm 75, a lower arm 76 and a connecting body 71 connecting the rear of the upper arm 75 and the rear of the lower arm 76. A free end of the upper arm 75 extends forward and inclines downward to form a first elastic arm 77. A free end of the first elastic arm 77 extends forward and inclines upward to form a second elastic arm 72. The front of the second elastic arm 72 protrudes upward to form a hook 73. The rear of the connecting body 71 protrudes rearward to form a holding portion 74. When a plug connector with the latch 70 is inserted in a receptacle connector, the hook 73 of the latch 70 buckles into a corresponding structure of the receptacle connector. However, the second elastic arm 72 of the latch 70 inclines upward entirely to cause the top of the second elastic arm 72 is apart from the receptacle connector. When an external force acts on the connectors, the second elastic arm 72 of the latch 70 is apt to rock up and down and further lead the plug connector to rock up and down to cause the plug connector and the receptacle connector contact with each other badly.

SUMMARY OF THE INVENTION

It is an object of the present invention to provide a plug connector which can contact with a receptacle connector steadily.

The plug connector includes an insulating housing, a plurality of terminals and two latches. The insulating housing has a base and a tongue portion protruding forward from the front of the base. The terminals are received in the insulating housing. Two cavities are defined at two sides of the base and the tongue portion for receiving the respective latches. Each of the latches has a fixing portion. The fixing portion extends forward and inclines downward to form a first elastic arm. A free end of the first elastic arm extends forward and inclines upward to form a second elastic arm. The second elastic arm protrudes upward to form a hook at a free end thereof and a support portion lower than the hook at the rear of the hook. The hook and the support portion stretch out of the cavity to rise above the tongue portion.

As described above, when the plug connector is inserted in the receptacle connector, the hook buckles into a corresponding structure of the receptacle connector to prevent the plug connector falling off. Because, the support portion is exposed above the tongue portion, when an external force acts on the connectors, the support portion abuts against the receptacle connector to prevent the second elastic arm rocking up and down and further to prevent the plug connector rocking up and down. Therefore, the plug connector and the receptacle connector can contact with each other steadily.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 3:
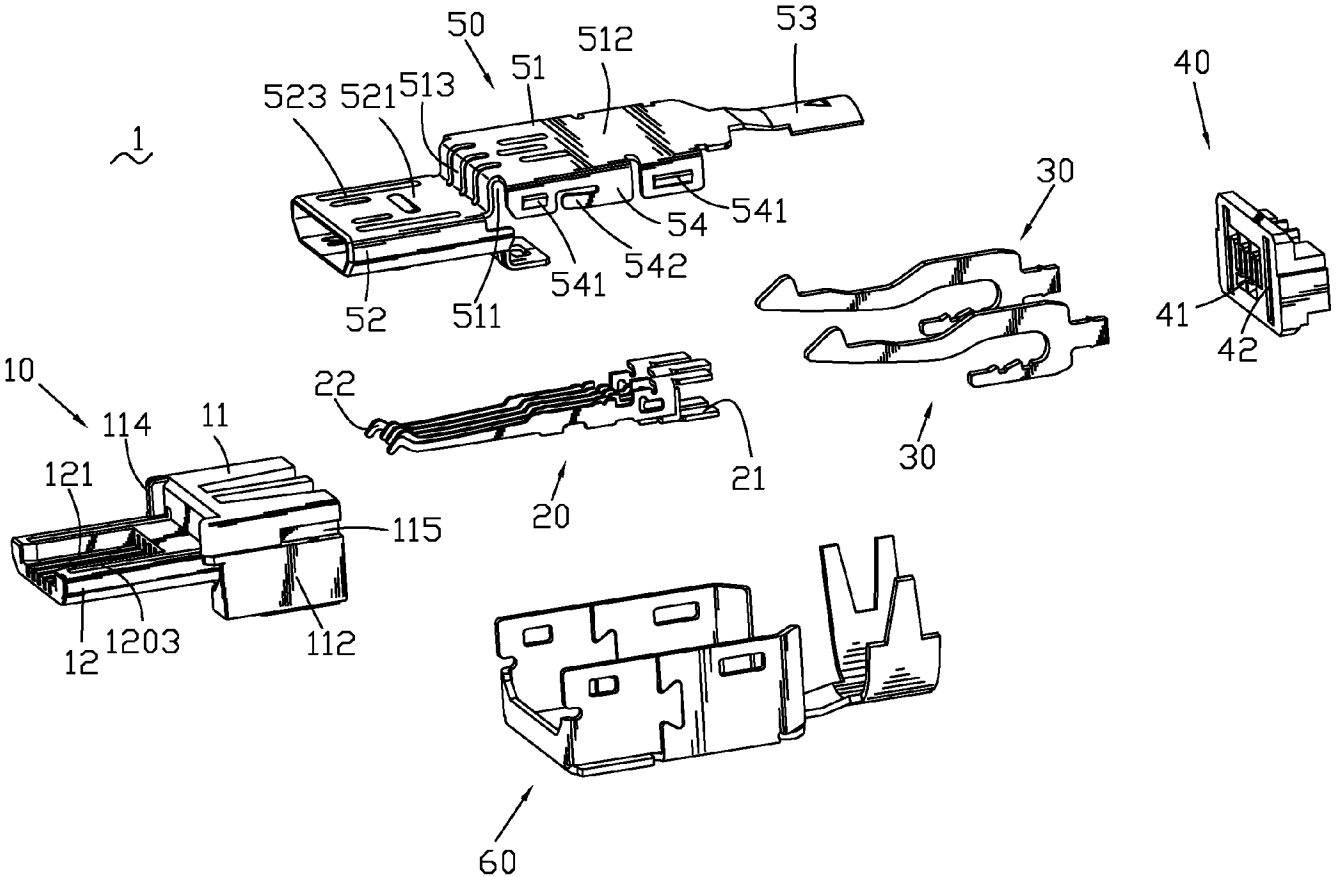
FIG. 3 is an exploded perspective view of the plug connector in accordance with the present invention.

Referring to FIG. 3, a plug connector 1 according to the present invention includes an insulating housing 10, a plurality of terminals 20, a pair of latches 30, a rear lid 40, an upper metal cover 50 and a lower metal cover 60.

Figure 4:
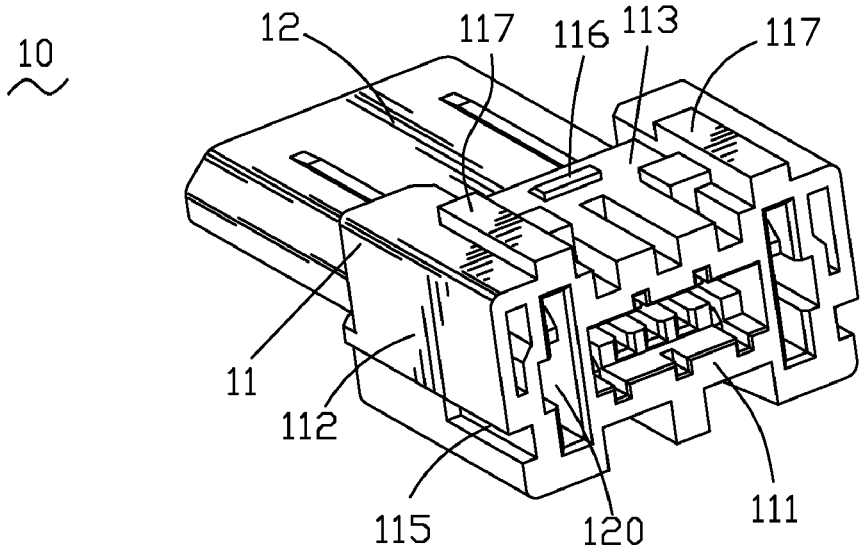
FIG. 4 is a perspective view of an insulating housing of the plug connector.
Figure 5:
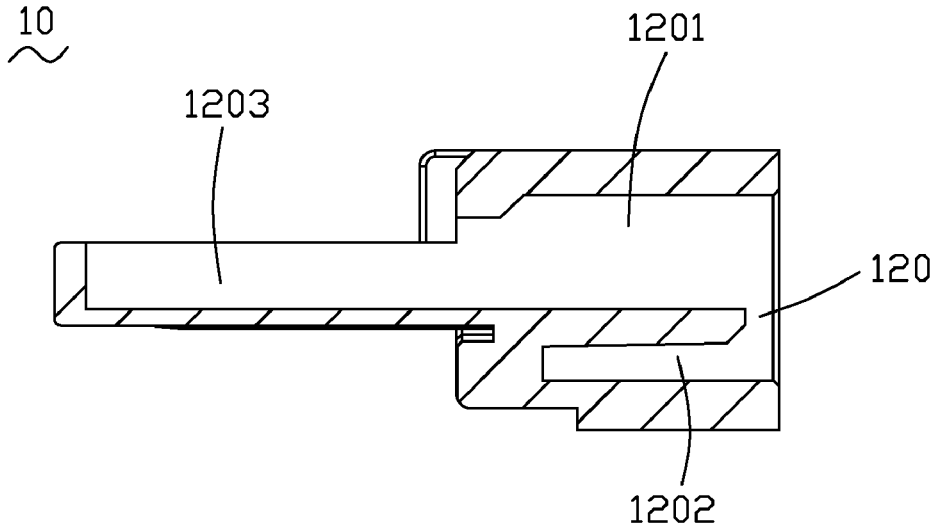
FIG. 5 is a cross-sectional view of the insulating housing of FIG. 4.

Referring to FIGS. 3-5, the insulating housing 10 has a base 11 and a tongue portion 12 which is formed by the base 11 stretching forward from the middle thereof. The base 11 has a rear wall 111, two sidewalls 112 and a bottom wall 113. Each of the sidewalls 112 protrudes forward to form a fixing projection 114 above the tongue portion 12. The rear of the sidewall 112 defines a preventing recess 115. The middle of the bottom wall 113 protrudes downward to form a locking projection 116. Two sides of the bottom wall 113 respectively protrude downward to form a fixing block 117. Two sides of the rear wall 111 respectively vertically define a base cavity 120. The top of the base cavity 120 extends forward to form an upper cavity 1201. The bottom of the upper cavity 1201 extends forward to the front of the tongue portion 12 for defining a front cavity 1203 penetrating the top of the tongue portion 12. The bottom of the base cavity 120 stretches forward to the middle of the base 11 to form a lower cavity 1202. The middle of the top of the tongue portion 12 defines a plurality of receiving slots 121 extending rearward to penetrate the base 11. The terminal 20 is received in the corresponding receiving slot 121 and has a soldering section 21 at the rear thereof and a contacting section 22 at the front thereof. The rear lid 40 defines a plurality of channels 41 penetrating from front to rear for receiving the soldering sections 21. Two sides of the rear lid 40 respectively define a fillister 42 penetrating from front to rear.

Figure 1:
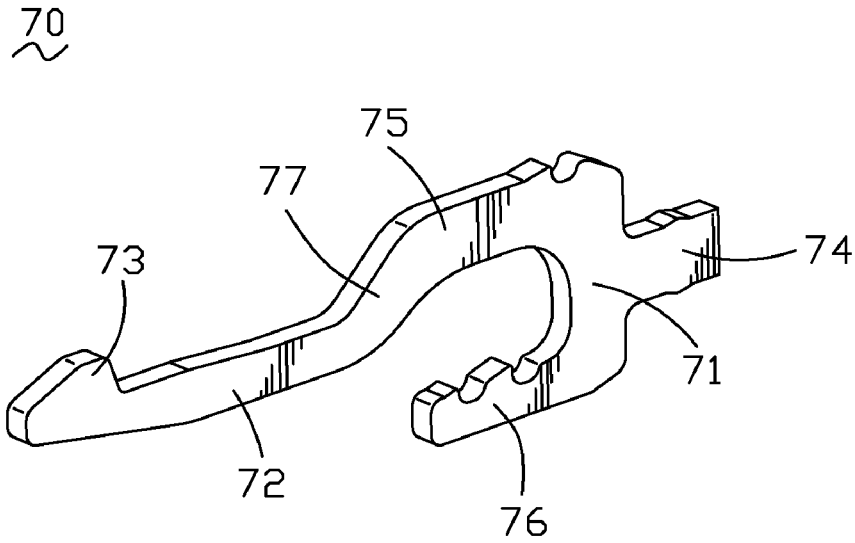
FIG. 1 (Prior Art)
FIG. 1 is a perspective view of a traditional latch.
Figure 2:
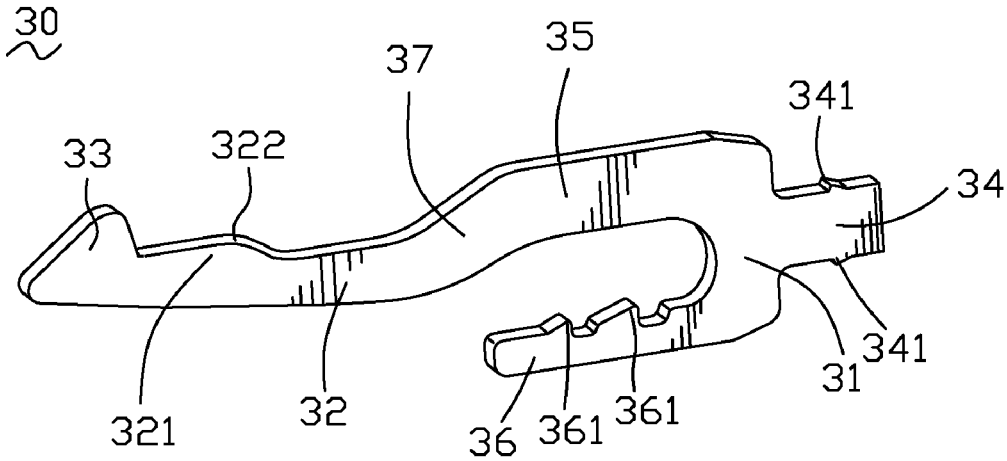
FIG. 2 is a perspective view of a latch of a plug connector according to the present invention.

Referring to FIG. 2, the latch 30 has an U-shaped fixing portion, the fixing portion has an upper arm 35, a lower arm 36 and a connecting body 31 connecting the rear of the upper arm 35 and the rear of the lower arm 36. A free end of the upper arm 35 of the fixing portion extends forward and inclines downward to form a first elastic arm 37. A free end of the first elastic arm 37 extends forward and inclines upward to form a second elastic arm 32. The front of the second elastic arm 32 protrudes upward to form a hook 33. The top of the second elastic arm 32 protrudes upward to form a support portion 321 adjacent to the hook 33 and lower than the hook 33. The support portion 321 has two flat slopes jointing each other to form a top point 322 and extending oppositely to smoothly joint the second elastic arm 32. The top of the lower arm 36 defines a plurality of lumps 361. The rear of the connecting body 31 protrudes rearward to form a holding portion 34. The top and the bottom of the holding portion 34 respectively define a bump 341.

Figure 6:
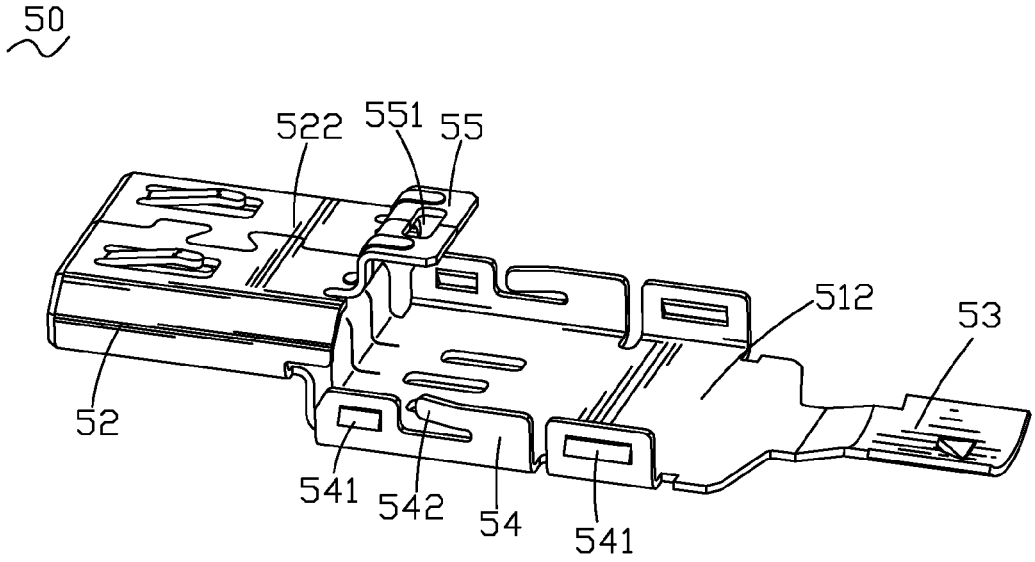
FIG. 6 is a perspective view of an upper metal cover of the plug connector.
Figure 7:
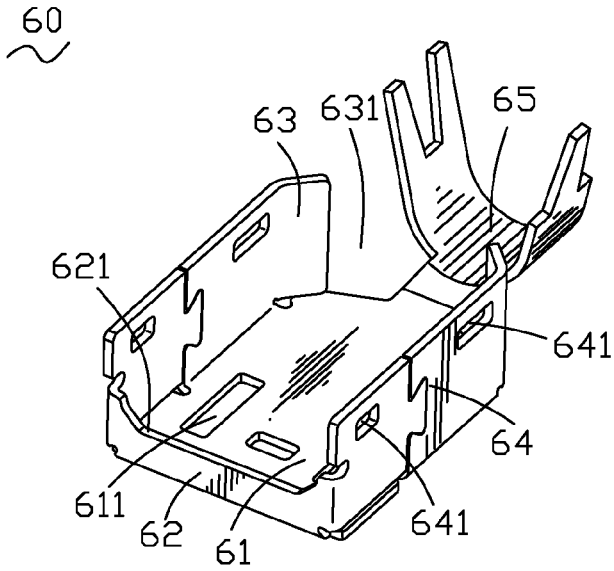
FIG. 7 is a perspective view of a lower metal cover of the plug connector.

Referring to FIGS. 3, 6 and 7, the upper metal cover 50 has a hollow front cover 52 and a rear cover 51 at the rear of the front cover 52. The front cover 52 has a top plate 521 and a bottom plate 522. Two sides of the top plate 521 respectively define a holding slot 523 extending longitudinally. The middle of the rear of the bottom plate 522 bends downward and then extends rearward to form a locking plate 55. The locking plate 55 defines a locking hole 551 corresponding to the locking projection 116 of the insulating housing 10. The rear of the top plate 521 bends upward to form a connecting section 513. The rear cover 51 has a top board 512 connected to the top of the connecting section 513 and two side plates 54 bending downward from two opposite sides of the top board 512 respectively. Each side plate 54 protrudes outward to form two locking blocks 541. The side plate 54 defines a locking arm 542 having a rear end connected to the side plate 54 and a front end inclining inward freely. Two sides of the connecting section 513 respectively open a fixing recess 511. The middle of the top board 512 of the rear cover 51 extends rearward to form a fastening section 53. The lower metal cover 60 includes a basic plank 61, a front plank 62, a rear plank 63 and two side planks 64. Two sides of the basic plank 61 respectively define a fixing opening 611 corresponding to the fixing block 117 of the insulating housing 10. The front plank 62 defines a front mouth 621 at the top thereof, and the rear plank 63 defines a rear mouth 631 at the middle thereof. Each side plank 64 opens two apertures 641 in accordance with the corresponding locking blocks 541 of the upper metal cover 50. The middle of the rear of the basic plank 61 extends rearward to form a retention section 65.

Figure 8:
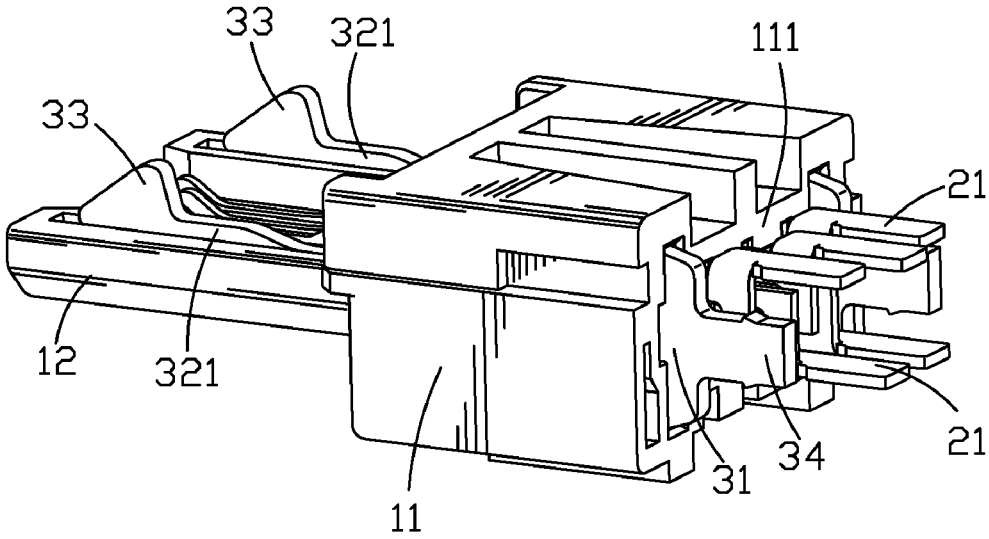
FIG. 8 is an assembled view of the insulating housing, the terminals and the latches of the plug connector.
Figure 9:
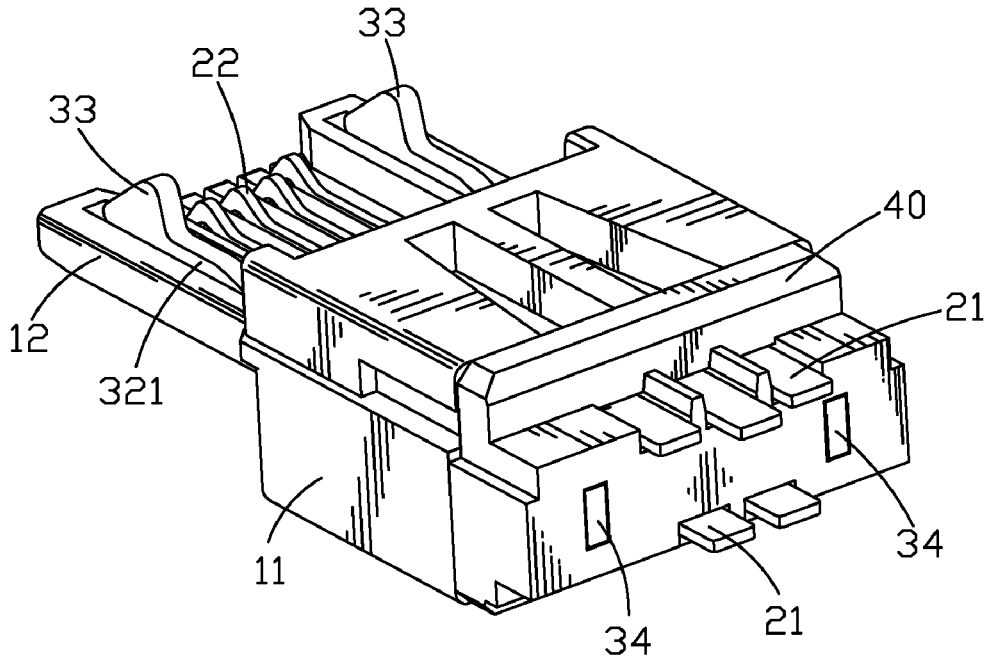
FIG. 9 is a perspective view of the plug connector without the upper metal cover and the lower metal cover.
Figure 10:
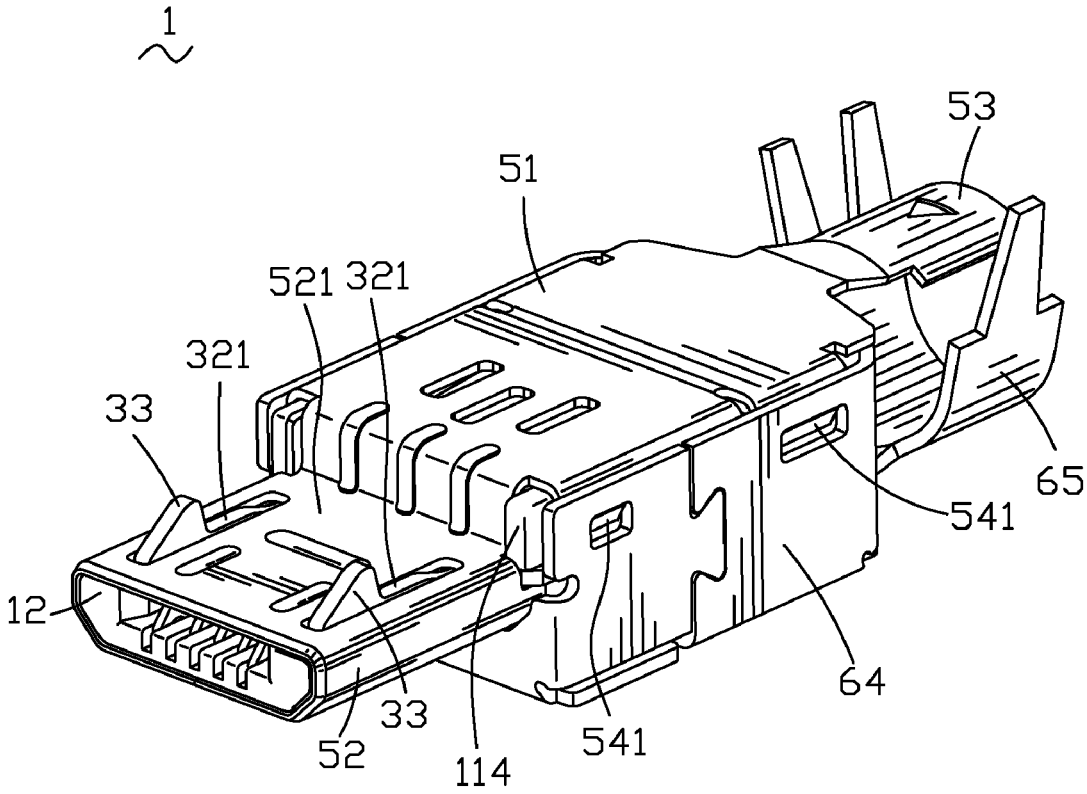
FIG. 10 is a perspective view of the plug connector of FIG. 3.

Referring to FIGS. 8-10, in assembly, the terminals 20 are received in the respective receiving slots 121 of the insulating housing 10, the soldering sections 21 stretch out of the rear wall 111 of the base 11, the contacting sections 22 stretch upward out of the respective receiving slots 121 for elastically contacting a receptacle connector (not shown). The front of the connecting body 31 of the latch 30 is held in the corresponding base cavity 120 of the insulating housing 10. The upper arm 35 and the first elastic arm 37 are received in the upper cavity 1201 and the lower arm 36 is received in the lower cavity 1202. The lumps 361 abut against the inner wall of the lower cavity 1202. The second elastic arm 32 is received in the front cavity 1203, the hook 33 and the support portion 321 protrude out of the front cavity 1203. The holding portion 34 and the rear of the connecting body 31 stretch out of the rear wall 111 of the base 11. The front of the rear lid 40 abuts against the rear wall 111 of the base 11. The soldering section 21 of the terminal 20 is inserted in the corresponding channel 41 to be soldered with a cable (not shown). The holding portion 34 and the rear of the connecting body 31 are inserted into the corresponding fillister 42 and the bumps 341 abut against the inner wall of the fillister 42. Therefore, the rear lid 4 is assembled with the insulating housing 10 firmly and prevents the terminal 20 moving rearward.

The upper metal cover 50 buckles with the lower metal cover 60 and the front cover 52 of the upper metal cover 50 stretches out of the front mouth 621 of the lower metal cover 60. The rear cover 51 of the upper metal cover 50 and the lower metal cover 60 define a space therebetween and the base 11 of the insulating housing 10 and the rear lid 40 are received in the space. The tongue portion 12 is inserted in the front cover 52. The support portion 321 of the latch 30 is located in the holding slot 523 of the front cover 52 and protrudes out a little of the holding slot 523. The hook 33 stretches out of the holding slot 523. The fixing projection 114 of the insulating housing 10 is inserted in the corresponding fixing recess 511 of the upper metal cover 50. The locking arm 542 of the side plate 54 buckles into the corresponding preventing recess 115 of the base 11 to prevent the insulating housing 10 moving rearward. The locking plate 55 is against the bottom wall 113 of the base 11 and the locking projection 116 buckles into the locking hole 551 to fix the insulating housing 10. The fixing block 117 buckles into the corresponding fixing opening 611 of the lower metal cover 60. The locking blocks 541 of the upper metal cover 50 buckle into the corresponding apertures 641 of the lower metal cover 60 to fix the lower metal cover 60 and the upper metal cover 50. The cables soldered to the soldering sections 21 pass through the rear mouth 631 of the lower metal cover 60 and are fastened by the fastening section 53 and the retention section 65.

As described above, when the plug connector 1 is inserted in the receptacle connector, the hook 33 of the latch 30 buckles into a corresponding structure of the receptacle connector to prevent the plug connector 1 falling off. Because, the support portion 321 of the latch 30 stretches out a little of the holding slot 523 of the front cover 52, when an external force acts on the connectors, the support portion 321 can abut against the receptacle connector to prevent the second elastic arm 32 of the latch 30 rocking up and down and further to prevent the plug connector 1 rocking up and down. Therefore, the plug connector 1 and the receptacle connector can communicate with each other steadily.

What is claimed is:

1. A plug connector, comprising:

an insulating housing having a base and a tongue portion protruding forward from the front of the base, two cavities being defined at two sides of the base and the tongue portion;

a plurality of terminals received in the insulating housing; and two latches received in the respective cavities, each of the latches having a fixing portion, the fixing portion extending forward and inclining downward to form a first elastic arm, a free end of the first elastic arm extending forward and inclining upward to form a second elastic arm, the second elastic arm protruding upward to form a hook at a free end thereof and a support portion lower than the hook at the rear of the hook, the hook and the support portion stretching out of the cavity to rise above the tongue portion.

2. The plug connector as claimed in claim 1, wherein the support portion of the latch is adjacent to the hook.

3. The plug connector as claimed in claim 2, wherein the support portion has two flat slopes jointing each other to form a top point and extending oppositely to smoothly joint the second elastic arm.

4. The plug connector as claimed in claim 1, further comprising a cover wrapping the tongue portion, the top of the cover defining two holding slots, the support portion and the hook stretching out of the corresponding holding slot.

5. The plug connector as claimed in claim 1, wherein the fixing portion is U-shaped and has an upper arm, a lower arm and a connecting body connecting the rear of the upper arm and the rear of the lower arm, the first elastic arm extends from the upper arm.

6. The plug connector as claimed in claim 5, further comprising a rear lid, two sides of the rear lid respectively defining a fillister, wherein the connecting body of the latch extends rearward to form a holding portion stretching out of the insulating housing to insert into the corresponding fillister.

* * * * *